US006831534B2

(12) United States Patent
Rodriguez et al.

(10) Patent No.: US 6,831,534 B2
(45) Date of Patent: Dec. 14, 2004

(54) EXTERNAL ACTUATOR INTERLOCK MECHANISM FOR CIRCUIT BREAKER

(75) Inventors: Mauricio Rodriguez, Duluth, GA (US); James E. Ferree, Lawrenceville, GA (US); Solomon Titus, Alpharetta, GA (US); David A. Leone, Lilburn, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 10/607,319

(22) Filed: Jun. 26, 2003

(65) Prior Publication Data

US 2004/0066260 A1 Apr. 8, 2004

Related U.S. Application Data

(62) Division of application No. 09/435,267, filed on Nov. 5, 1999, now Pat. No. 6,597,266.

(51) Int. Cl.[7] ..... H01H 67/02
(52) U.S. Cl. ..... 335/132; 335/202
(58) Field of Search ..... 335/132, 202, 335/23–25, 165–176, 14, 20; 200/293–308

(56) References Cited

U.S. PATENT DOCUMENTS 4,742,321 A * 5/1988 Nagy et al. ..... 335/20
5,581,219 A * 12/1996 Nozawa et al. ..... 335/132

* cited by examiner

*Primary Examiner*—Lincoln Donovan

(57) ABSTRACT

A circuit breaker (10, 12) includes a sensing circuit (48, 50, 52), a control circuit (46), an actuator (42), an operating mechanism, and an interlock mechanism (70, 94). The sensing circuit (48, 50, 52) is configured to generate the sense signal representative of a power signal flowing through a power circuit (54, 56, 58). The control circuit (46) has a frame (74, 76) and is configured to receive the sense signal and to provide a trip signal on a first terminal (68). The actuator (42) is external to the control circuit frame (74, 76) and has a second terminal (98) coupleable to the first terminal (68). The actuator (42) is configured to receive the trip signal on the second terminal (98). The operating mechanism is coupled to the actuator (42) and is configured to open and close the power circuit in response to actuation of a lever (36). The actuator (42) is configured to actuate the lever (36) in response to the trip signal. The interlock mechanism (70, 94) is coupled to at least one of the actuator (42) and the operating mechanism and is configured to actuate the lever (36) when the first terminal (68) is not coupled to the second terminal (98).

8 Claims, 9 Drawing Sheets

EXTERNAL ACTUATOR INTERLOCK MECHANISM FOR CIRCUIT BREAKER

CROSS-REFERENCE TO RELATED PATENT APPLICATIONS

This application is a Division of U.S. application Ser. No. 09/435,267, filed Nov. 5, 1999, now U.S. Pat. No. 6,597, 266, issued Jul. 22, 2003, incorporated herein by reference in its entirety.

FIELD OF THE INVENTION

The present invention relates generally to the field of actuators for electronic circuit breakers, and more particularly to circuit breakers having an electronic trip unit and an external actuator coupleable to the electronic trip unit.

BACKGROUND OF THE INVENTION

Some circuit breakers (e.g., molded case circuit breakers, or MCCBs) utilize a mechanical trip unit comprising, for example, a bi-metallic sensing element to sense trip conditions in a power signal, such as, overcurrent, ground fault, short circuit, etc. More modern circuit breakers utilize an electronic trip unit and current transformers. The current transformers sense one or more phases of the power signal and provide sense signals to the electronic trip unit. The electronic trip unit, typically using microprocessor controls, digitizes the sense signals and determines when a circuit breaker trip is needed based on detection of one of the trip conditions. The electronic trip unit then provides a trip signal to an actuator (e.g., a mag-latch) which provides the necessary force to trip the mechanical operating mechanism which, in turn, provides a break in the power line.

In some electronic circuit breakers, the mechanical trip unit is removable from the circuit breaker casing or frame. Thus, the mechanical trip unit can be replaced with a new mechanical trip unit or even an electronic trip unit. Also, a mechanical interlock has been provided to assure that the electronic trip unit is properly coupled to the frame of the circuit breaker.

One challenge in designing electronic circuit breakers is to provide all of the necessary and desirable functionality, including testing functions, sense signal amplifiers, actuators, operator input devices, and operator displays, in a limited amount of space. Since the mag-latch is a large component, it has been proposed to remove the mag-latch from the electronic trip unit and package the mag-latch for installation on the circuit breaker separate or external from the electronic trip unit. However, one drawback of having an external mag-latch is that the mag-latch must be properly installed and all electrical connections between the mag-latch and the electronic trip unit must be complete for the circuit breaker to function properly. Also, the mechanical connections between the mag-latch and the operating mechanism must also be complete for the circuit breaker to function properly.

An improved circuit breaker is needed which will verify the coupling of a mag-latch or other actuator to a circuit breaker having an electronic trip unit. The mag-latch would be easily installable without the use of additional fasteners and not require complex testing systems or circuitry to verify the proper installation of the mag-latch. The mag-latch would also allow easy removal of the electronic trip unit without removing the mag-latch. The mag-latch would also provide communication between the electronic trip unit and the contacts of the operating mechanism.

SUMMARY OF THE INVENTION

One embodiment relates to a circuit breaker having a sensing circuit, a control circuit, an actuator, an operating mechanism, and an interlock mechanism. The sensing circuit is configured to generate the sense signal representative of a power signal flowing through a power circuit. The control circuit has a frame and is configured to receive the sense signal and to provide a trip signal on a first terminal. The actuator is external to the control circuit frame and has a second terminal coupleable to the first terminal. The actuator is configured to receive the trip signal on the second terminal. The operating mechanism is coupled to the actuator and is configured to open and close the power circuit in response to actuation of a lever. The actuator is configured to actuate the lever in response to the trip signal. The interlock mechanism is coupled to at least one of the actuator and the operating mechanism and is configured to actuate the lever when the first terminal is not coupled to the second terminal.

Another embodiment relates to a circuit breaker having sensing means for generating a sense signal representative of a power signal flowing through a power circuit, control means for receiving the sense signal and for generating a trip signal based on the sense signal, and trip means for opening and closing the power circuit. The circuit breaker has a first means for receiving the trip signal and for tripping the trip means and a second means for determining whether the first means is coupled to the control means and for tripping the trip means when the first means is not coupled to the control means.

Yet another embodiment relates to a method of interlocking an actuator to a circuit breaker, the circuit breaker having a sensing circuit configured to generate a sense signal representative of a power signal flowing through a power circuit, a control circuit configured to receive the sense signal and to provide a trip signal on a first terminal based on the sense signal, an actuator external to the control circuit frame having a second terminal coupleable to the first terminal, and an operating mechanism configured to open and close the power circuit. The method includes receiving the trip signal and tripping the operating mechanism when the trip signal is received, determining whether the first terminal is coupled to the second terminal, and tripping the operating mechanism when the first terminal is not coupled to the second terminal.

Still another embodiment relates to an interlock mechanism for a circuit breaker having a control circuit and an actuator, the control circuit configured to provide a trip signal to the actuator, the actuator configured to trip the circuit breaker in response to the trip signal. The interlock mechanism includes a first connector coupled to the circuit breaker, the first connector having a first terminal and configured to receive the trip signal. The interlock mechanism also includes a second connector coupled to the actuator, the second connector having a second terminal and configured to receive the trip signal from the first terminal. One of the first and second connectors includes a protrusion and the other includes a resilient member biased toward the protrusion having a first and second position. The resilient member is coupled to a trip lever and the resilient member trips the circuit breaker via the trip lever only when the protrusion is in the first position.

DETAILED DESCRIPTION OF THE PREFERRED EMBODIMENTS

Figure 7B:
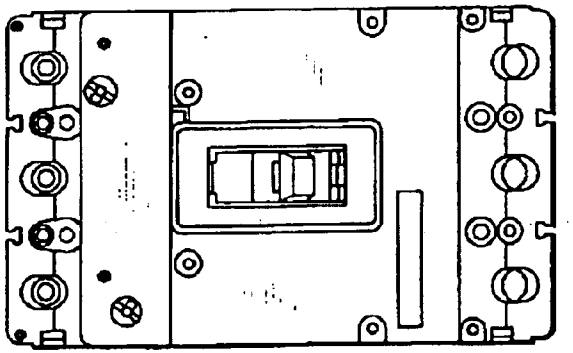
FIGS. 7A–7C are front, top, and side views of the circuit breaker of FIG. 1.
Figure 7A:
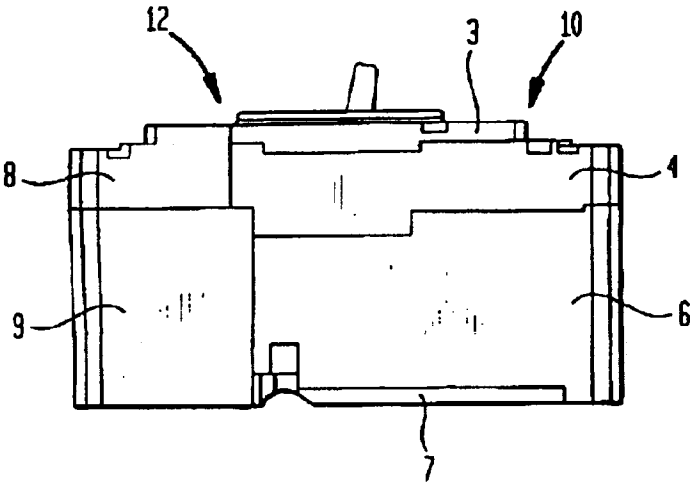
Figure 7C:
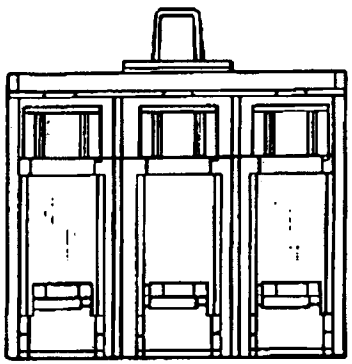

Referring first to FIG. 7, a circuit breaker 2 is shown according to an exemplary embodiment. Circuit breaker 2 includes a first portion 10 (e.g., a breaker frame) and a second portion 12 (e.g., an interchangeable trip unit) shown assembled together. Circuit breaker 2 in this exemplary embodiment is a 160/250A molded case circuit breaker (MCCB), but may alternatively be a circuit breaker of other types or ratings. First portion 10 includes an accessory cover 3, a main cover 4, a main base 6, and a sub base 7. Second portion 12 includes an external cover 8 and a base 9. Second portion 12 further includes a magnetic adjustment knob 11 Second portion 12 is removable from first portion 10. Second portion 12 may comprise an electronic trip unit, a mechanical trip unit, or other trip units.

Figure 1:
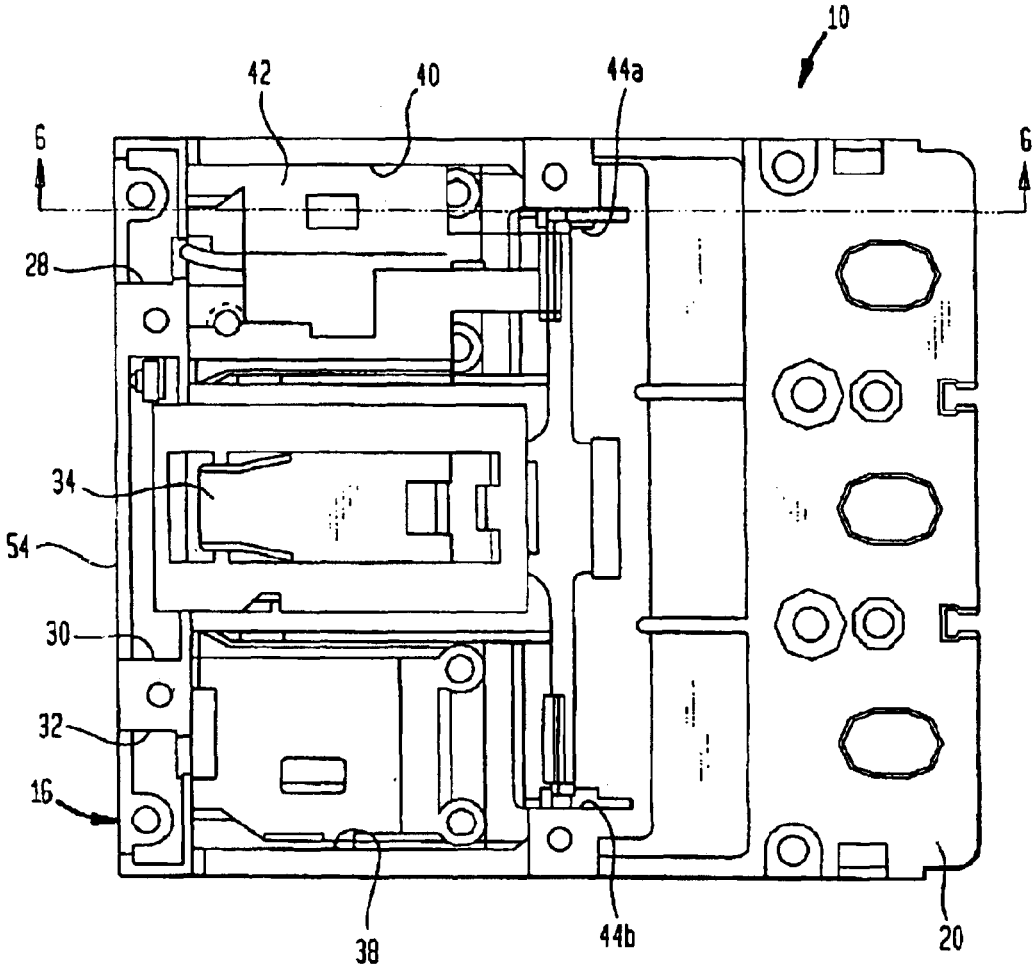
FIG. 1 is a top view of a portion of a circuit breaker having an external actuator according to an exemplary embodiment.
Figure 2:
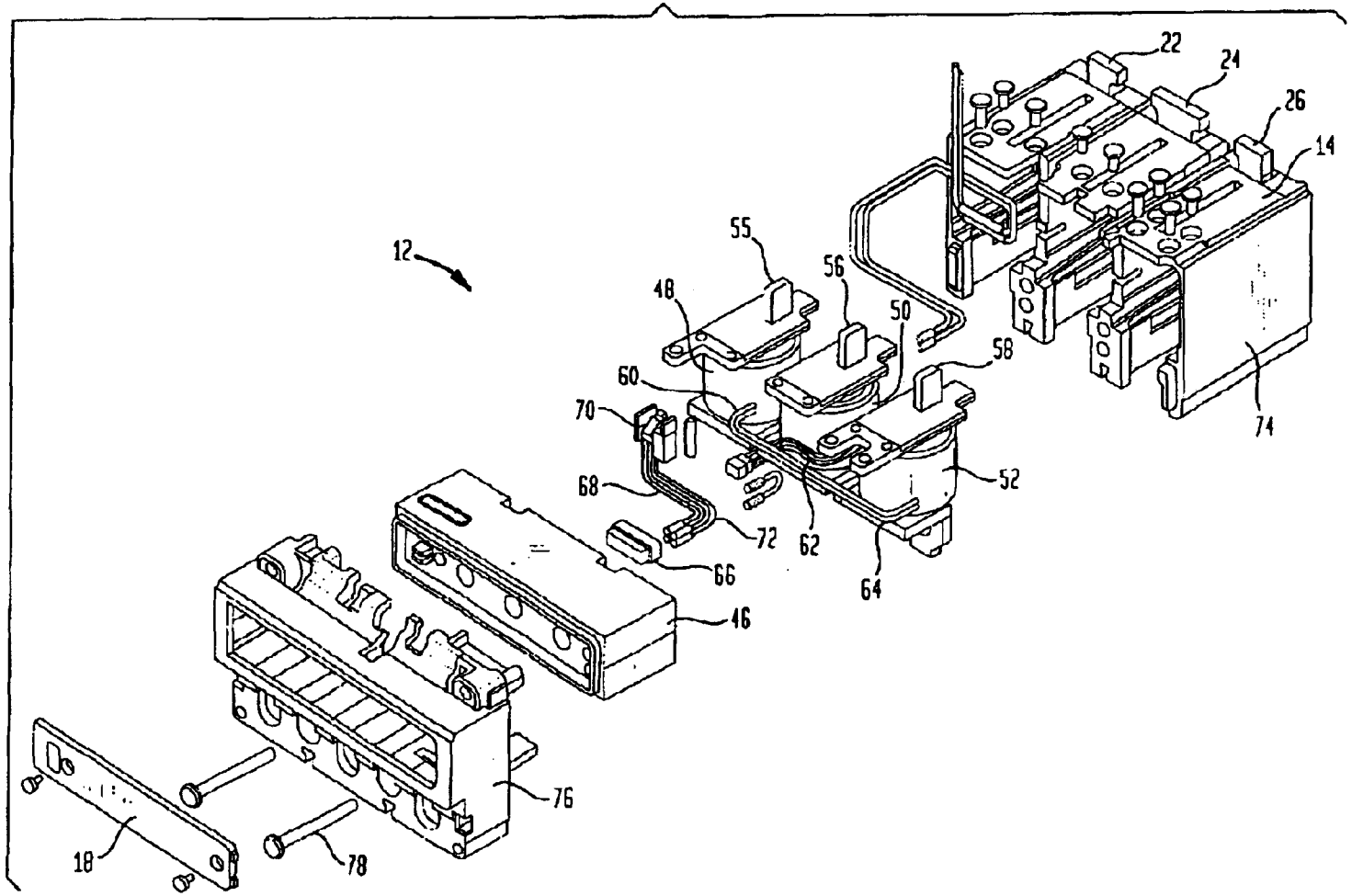
FIG. 2 is an exploded view of a second portion of the circuit breaker of FIG. 1.

Referring to FIG. 1 and FIG. 2, circuit breaker 2 is disclosed in first portion 10 (FIG. 1) and second portion 12 (FIG. 2). To couple portion 12 with portion 10, a surface 14 on portion 12 is aligned with a surface 16. Thus, when portions 10 and 12 are joined, a top plate 18 is substantially co-plainer with a breaker cover 20. Protrusions 22, 24, and 26 of portion 12 slide into mating alignment with apertures 28, 30, and 32 of portion 10.

Referring first to FIG. 1, first portion 10 includes an operating mechanism (not shown) such as that found in a conventional MCCB having contacts (e.g., two contact arms, at least one of which is movable) which open when circuit breaker 2 is tripped to remove power between a source and a load. Circuit breaker 2 is turned ON by movement of a handle 34 from a first position (as shown in FIG. 1) to a second position, which provides a complete circuit from source to load through the contacts. When handle 34 is returned to the first position, circuit breaker 2 is turned OFF and the contacts are separated from one another. Circuit breaker 2 is tripped by providing a force to a lever 54 (e.g., a trip bar, or intermediate lever) which releases a spring-loaded lever within the operating mechanism and breaks the power line from source to load, thereby creating an open circuit. When circuit breaker 2 is tripped, handle 34 may remain in the second position, circuit breaker 2 being re-set by moving handle 34 to the first position, then back to the second position.

Referring again to FIG. 1, portion 10 includes first and second pockets 38, 40 adapted to receive various accessory modules, for example, actuator 42 (e.g., a mag-latch) or a bell alarm (not shown). Actuator 42 may alternatively be a solenoid or other actuator. A mag-latch was selected for this embodiment for its ability to operate on low current. Portion 10 further includes an accessory retainer member 44*a*, 44*b* for each pocket comprising a lever coupled at one end via a spring-loaded pin or screw to portion 10. Accessory retainer members 44*a*, 44*b* are biased in a clockwise manner relative to portion 10 with the other end of the lever facing downward, and operate to retain accessories within pockets 38, 40 without the need for additional screws or other fasteners, as will be described in greater detail hereinafter with respect to FIG. 6.

Referring now to FIG. 2, portion 12 includes an electronic trip unit 46 comprising a control circuit (e.g., a microprocessor, or other digital and/or analog circuitry). Portion 12 is sometimes referred to as an electronic trip unit, and may alternatively be a mechanical or thermal/magnetic trip unit having a bi-metal sensing portion. Electronic trip unit 46 may, for example, be the electronic trip unit disclosed in commonly assigned U.S. application Ser. Nos. 09/435,110 filed Nov. 5, 1999 entitled "Circuit Breaker Having Programmable Amplifier" by Bilac and 09/435,186 filed Nov. 5, 1999 entitled "Method and Apparatus for Differentially Sensing Ground Fault and Individual Phases" by Bilac et al., both of which are herein incorporated by reference. Portion 12 further includes sensing circuits 48, 50, and 52 (e.g., current transformers), each for sensing one phase (A+, B+, or C+) of power flowing through one of respective power nodes 55, 56, and 58. Alternatively, only one of sensing circuits 48, 50 or 52 may be provided for sensing a single phase power source. Also, a fourth sensing circuit may be provided to sense an N+ phase of the power signal. Sensed signals are provided along respective busses 60, 62, 64 extending between sensing circuits 48, 50, and 52, via a port 66 to electronic trip unit 46.

Electronic trip unit 46 receives the sensed signals and monitors them to determine whether a trip condition (e.g., overcurrent, short circuit, ground fault, etc.) exists. If a trip condition exists, electronic trip unit 46 provides a trip signal along a bus 68 having a positive terminal and a negative terminal to a connector 70. Electronic trip unit 46 is further coupled to a bus 72 also coupled to connector 70, along which electronic trip unit 46 receives a break signal from connector 70 indicating the operating mechanism is in its "OFF" state, i.e., circuit breaker 2 is tripped, as will be described hereinafter with reference to FIG. 5A and FIG. 6. Portion 12 further includes a first frame 74, a second frame 76, and top plate 18 which join together via fasteners 78 to house components 46, 70, and 55–58.

Figure 3:
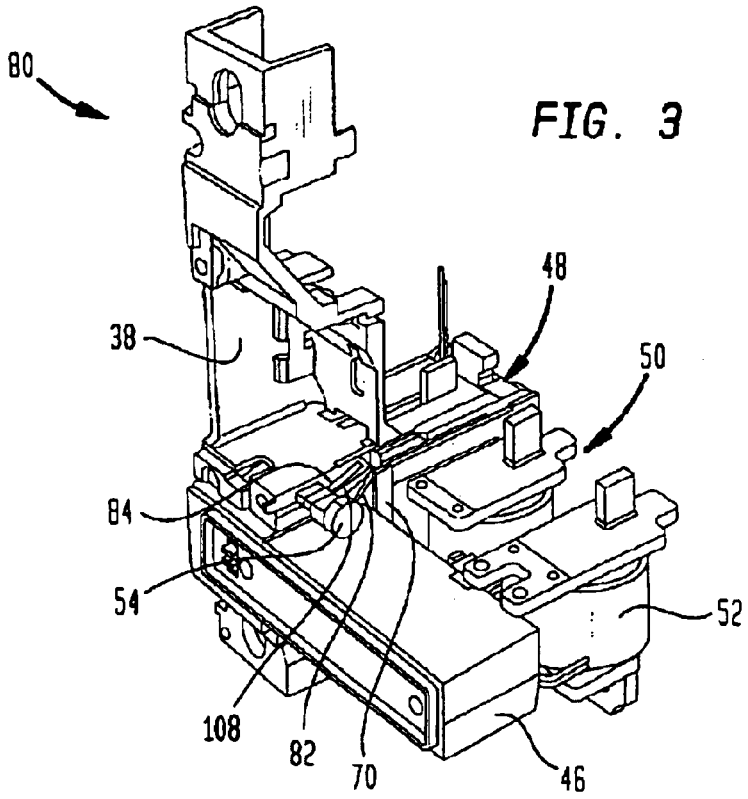
FIG. 3 is a broken perspective view of the circuit breaker of FIGS. 1 and 2 before installation of the actuator.

Referring now to FIG. 3, a broken portion 80 of circuit breaker 2 is shown. Portion 80 depicts pocket 38 without actuator 42 installed therein. FIG. 3 also depicts electronic trip unit 46 coupled to sensing circuits 48, 50, and 52. Portion 80 further includes connector 70 shown in an extended position. Connector 70 includes a protrusion 82 biased against protrusion 84 of trip bar 54. Protrusion 84 is also shown on trip bar 54 in FIG. 10. Thus, FIG. 3 shows only a cut-away view of trip bar 54.

Figure 4:
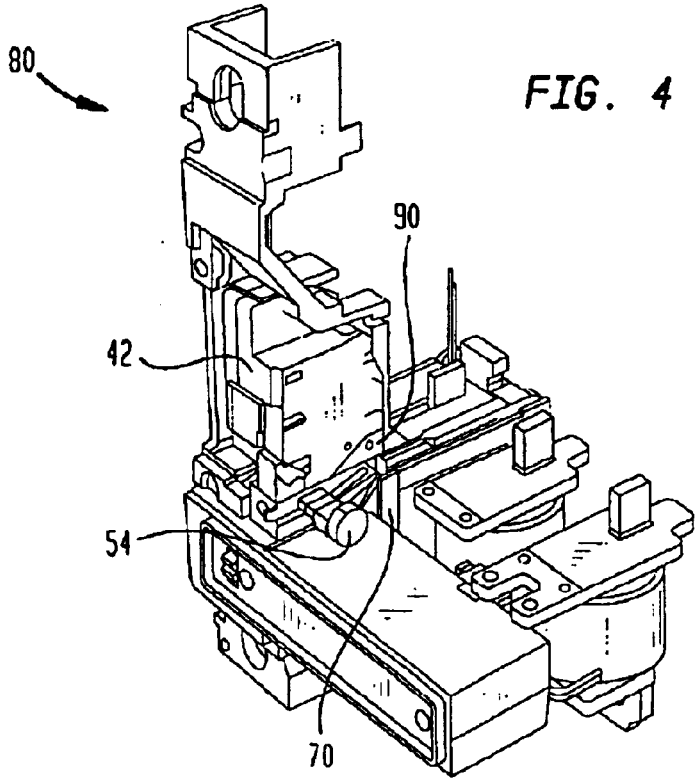
FIG. 4 is the same view as FIG. 3 after installation of the actuator.
Figure 9:
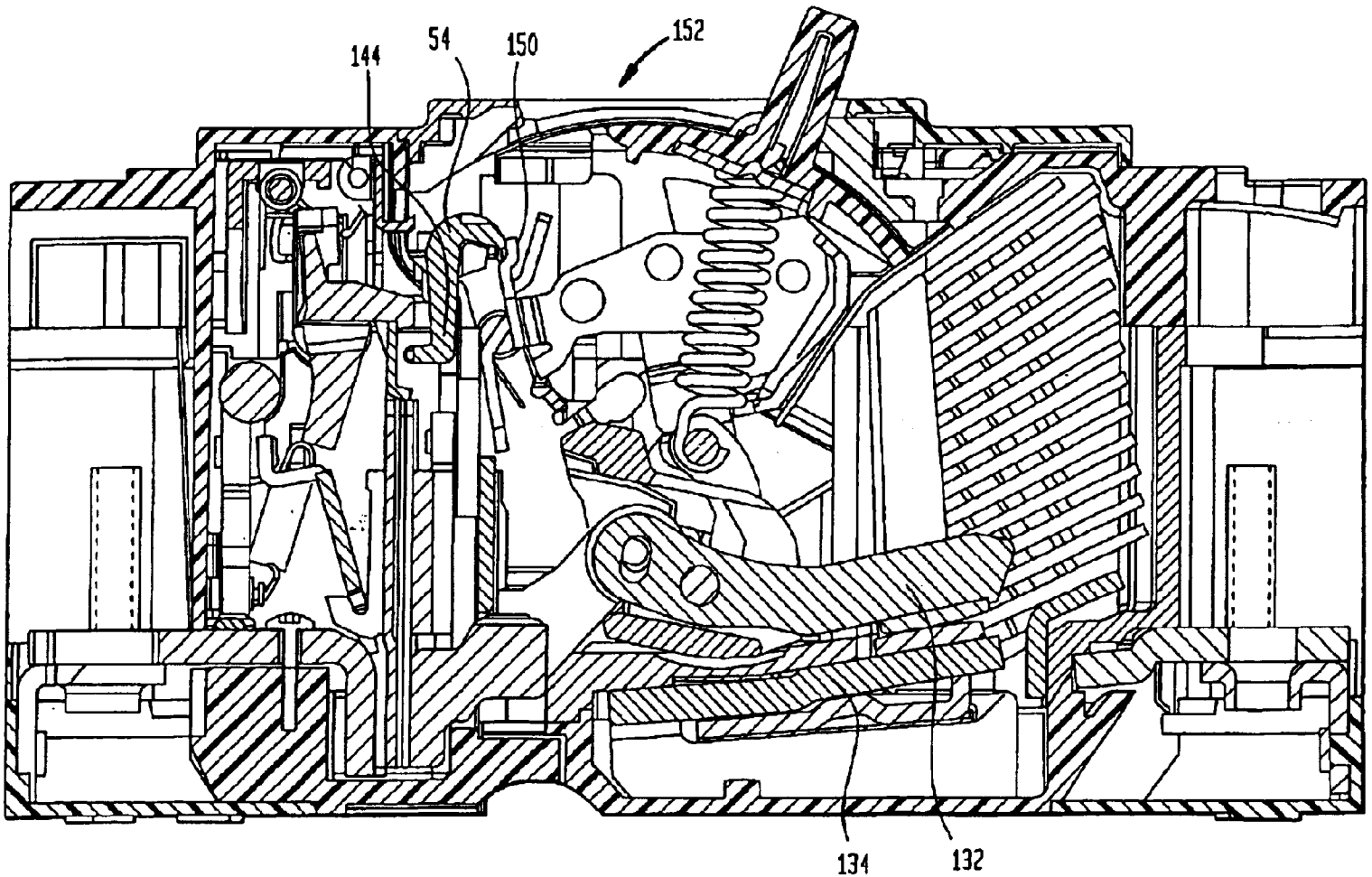
FIG. 9 is a sectional view of an exemplary embodiment of a circuit breaker having an operating mechanism and including a trip bar.

Trip bar 54 includes a first position (shown in FIG. 3) and a second position (show in FIG. 4). In the first position, trip bar 54 maintains circuit breaker 2 in its open or tripped position. Specifically, the bias of connector 70 forces protrusion 82 to hold trip bar 54 in the first position. Referring to FIG. 9, trip bar 54 is shown in the second position, having a protrusion 144 (see also FIG. 10) shown in cross-section. In the second position, trip bar 54 retains a z-shaped intermediate latch 150 in an untripped position. When trip bar 54 is rotated counter-clockwise to the first position (in FIG. 9); latch 150 slides to the left to a tripped position, tripping the circuit breaker via operating mechanism 152. Thus, so long as connector 70 maintains trip bar 54 in the first position, latch 150 will remain in the tripped position to maintain circuit breaker 2 in its open or tripped position.

In the second position, trip bar 54 (shown in FIG. 4) connector 70 does not provide a force against trip bar 54, thereby allowing an operator to latch the connectors of the operating mechanism to provide a closed circuit using handle 34. Thus, in this embodiment, connector 70 and trip bar 54 comprise an interlock mechanism which prevents an operator from turning circuit breaker 2 ON unless actuator 42 is properly installed, as will now be described.

Referring now to FIG. 4, portion 80 is shown with actuator 42 installed therein. Actuator 42 includes a protrusion 90 (e.g., a male connector) adapted to slide into connector 70 (e.g., a female connector). In doing so, female connector 70 slides downward, away from actuator 42, and against a spring bias force in the upward direction. Accordingly, protrusion 82 also moves downward, allowing lever 84 to rotate clockwise such that trip bar 54 may provide a bias against latch 150 (FIG. 9) to turn circuit breaker 2 ON. In this manner, when actuator 42 is properly installed, protrusion 90 acts with connector 70 to allow contacts 132, 134 of circuit breaker 2 in operating mechanism 152 to be coupled together via operator actuation of handle 34.

According to an alternative interlock mechanism, protrusion 90 could act directly on trip bar 54 rather than through connector 70. One skilled in the art will appreciate that many similar mechanical interlock configurations are possible, all of which are contemplated herein.

Figure 8:
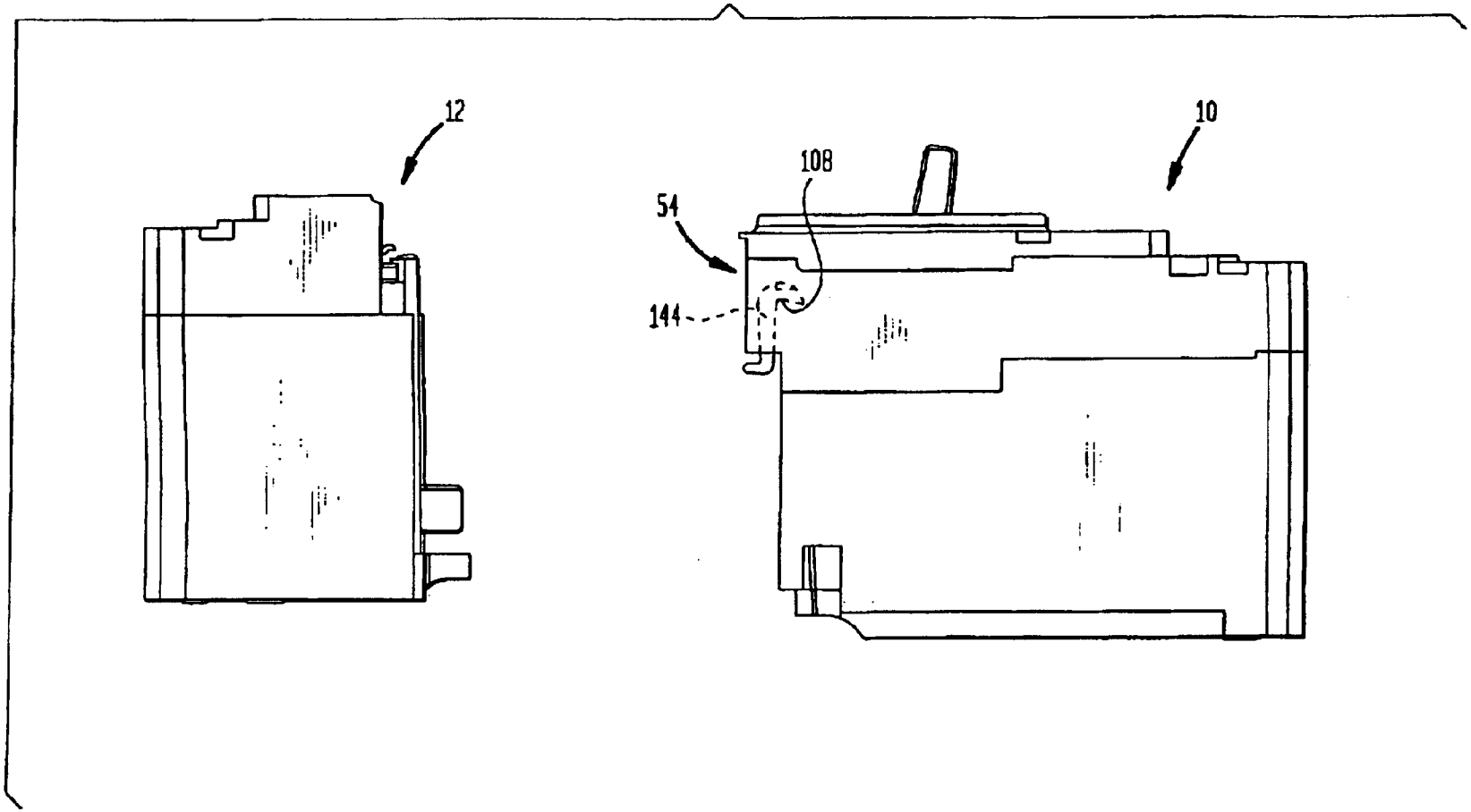
FIG. 8 illustrates an exemplary embodiment of a first portion (breaker frame) and second portion (trip unit) including a trip bar, in a disassembled state.

As mentioned, the bias of connector 70 maintains trip bar 54 in the first position. Referring now to FIG. 8, a more detailed disclosure of this operation is provided. FIG. 8 depicts first portion 10 and second portion 12 in a disassembled state. Trip bar 54 is disclosed which rotates on a horizontal axis 108. When trip bar 54 is in the first position (e.g., no actuator coupled to portion 10), trip bar 54 is biased counter-clockwise on axis 57. When trip bar 54 is in the second position (e.g., the actuator is properly coupled to portion 10), trip bar 54 is not so biased. So long as trip bar 54 does not bias latch 150 to the right in FIG. 9, the operator will be unable to set circuit breaker 2 in the ON position. Referring again to FIG. 9, a detailed disclosure of the operating mechanism is shown. Trip bar 54 is shown in an unbiased position and, thus, contacts 132, 134 are shown in an electrical coupling relationship. The operation of operating mechanism 152 depicted in FIG. 9 is described in commonly assigned and concurrently filed U.S. patent application Ser. No. 09/434,233, now U.S. Pat. No. 6,181,226 entitled "Bi-Metal Trip Unit for a Molded Case Circuit Breaker", for which the inventor is Leone, et al., which is hereby incorporated by reference herein.

Figure 10:
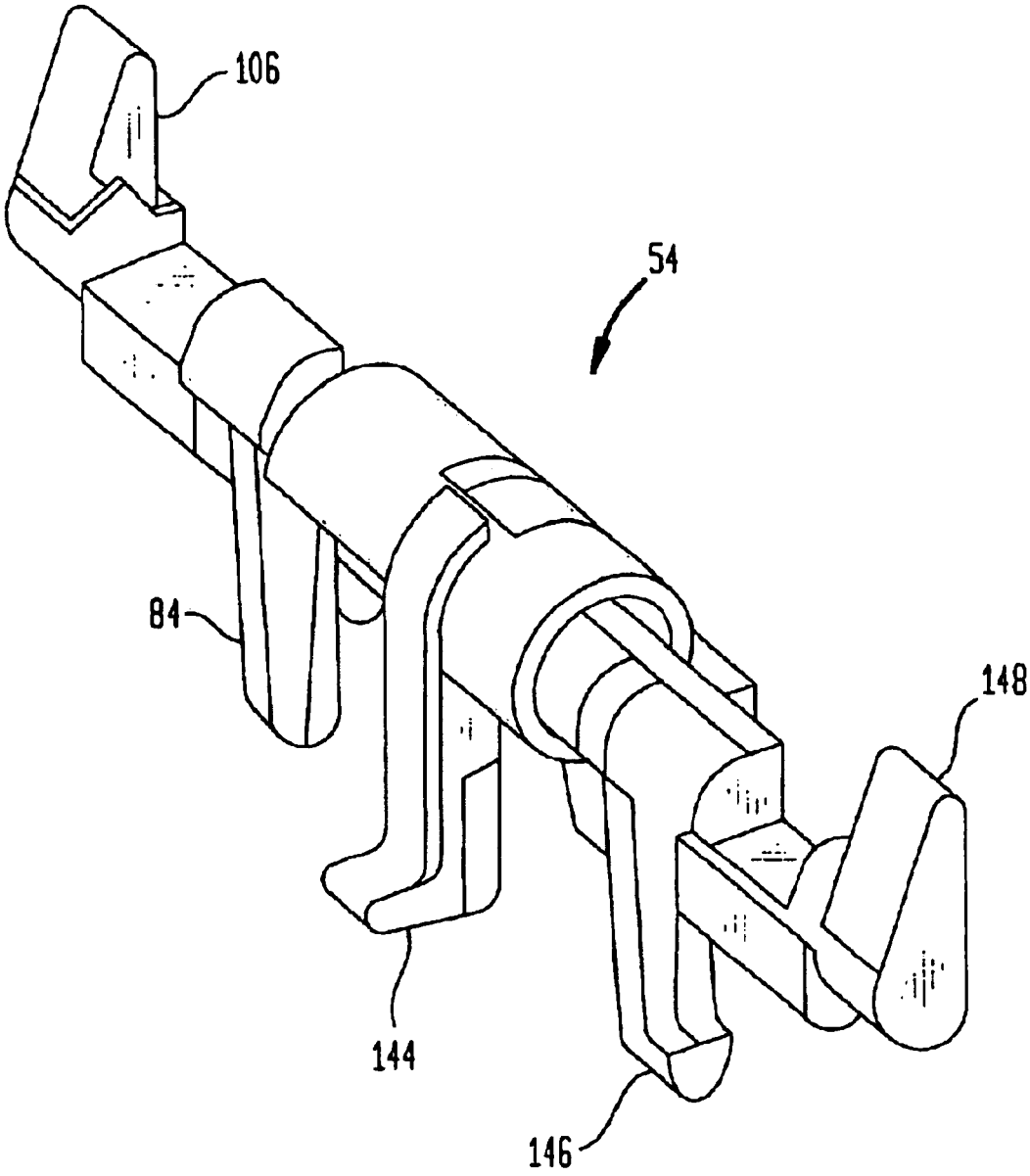
FIG. 10 is a perspective illustration of a trip bar.

Referring to FIG. 10, a perspective view of trip bar 54 is shown. Trip bar 54 includes protrusions 106, 84, 144, 146, and 148. When connector 70 is in the extended position, protrusion 82 acts against protrusion 84 to rotate trip bar 54 counter-clockwise. Thus, when portion 12 is coupled to portion 10 but actuator 42 is not properly installed in pocket 38, trip bar 54 provides an interlock to prevent circuit breaker 2 from being latched. Protrusion 144 is acted upon to trip the operating mechanism of portion 10 only when a mechanical or thermal/magnetic trip unit is attached to portion 10 (i.e., when portion 12 is a thermal/magnetic trip unit instead of an electronic trip unit, as in the exemplary embodiment).

Figure 5A:
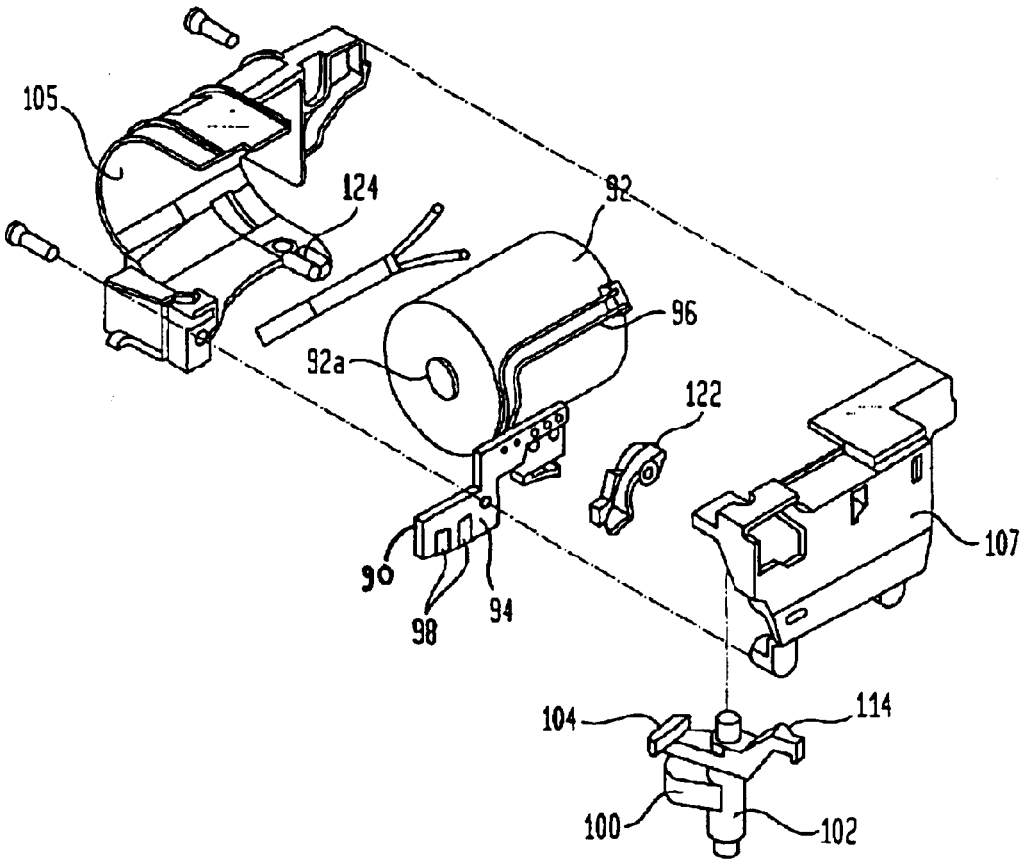
FIG. 5A is an exploded view of the actuator.
Figure 5B:
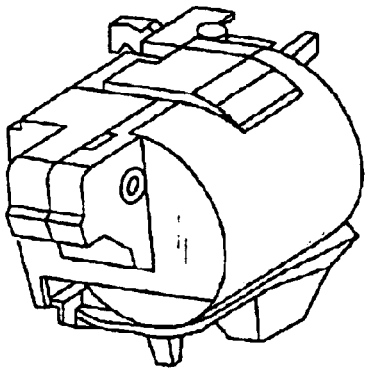
FIG. 5B is a front perspective view of the actuator of FIG. 5A.
Figure 5C:
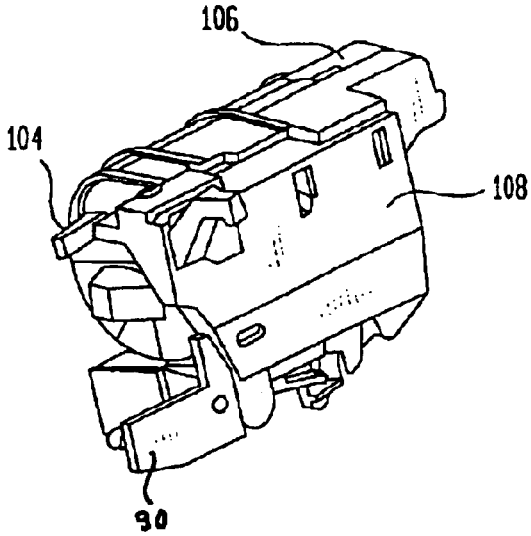
FIG. 5C is a rear perspective view of the actuator of FIG. 5A.

Referring now to FIGS. 5A–5C, additional views of actuator 42 are provided. In this exemplary embodiment, actuator 42 is a mag-latch. Therefore, a magnet 92 is coupled mechanically and electrically to a printed circuit board 94 via a mechanical connection and via bus 96, respectively. Circuit board 94 includes electrical contacts 98 (e.g. four terminals in this embodiment) also referred to as second terminal adapted for coupling to busses 68, 72 of connector 70 (FIG. 2). As mentioned, when electronic trip unit 46 determines that a trip is required, a trip signal is provided through bus 68 and through connector 70 also referred to as second terminal. The trip signal is then provided through electrical contacts 98, through printed circuit board 94, through bus 96 to magnet 92. In response, the coil in magnet 92 is powered, releasing a spring loaded plunger 92A inside magnet 92. Plunger 92A provides a force against protrusion 100 causing rotation of pivot member 102 in a counterclockwise direction, which causes pin 104 to protrude from casing 105, 107. (See FIG. 5C).

Figure 6:
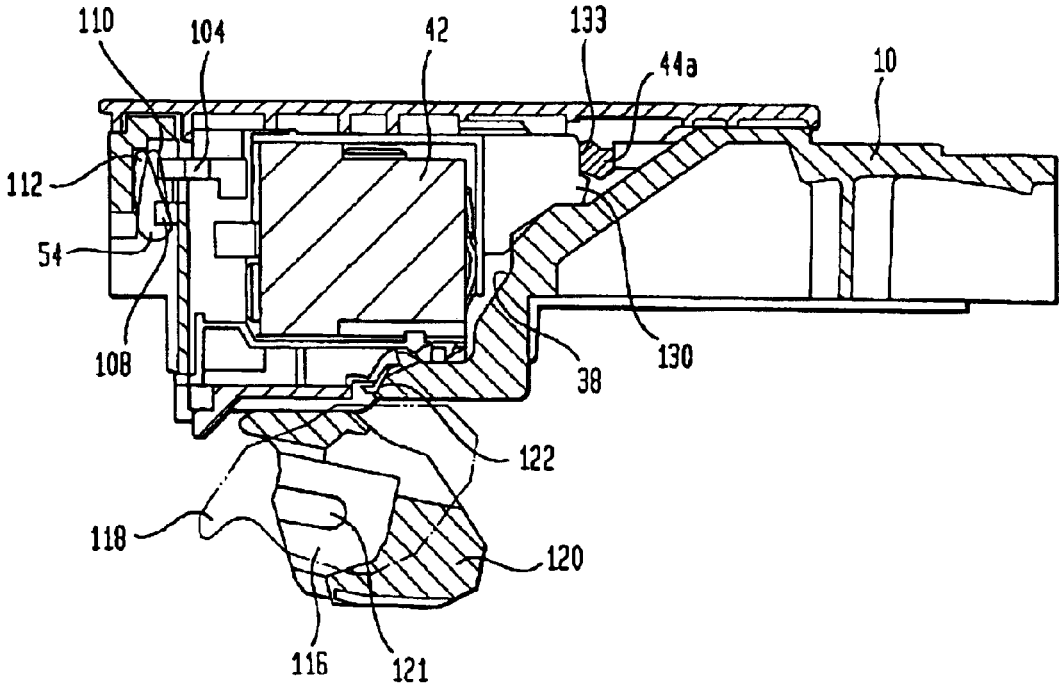
FIG. 6 is a cross-sectional view of a portion of the circuit breaker of FIG. 1, indicated generally by line 6—6 in FIG. 1.

Referring to FIG. 6, pin 104 presses against trip bar 54 and rotates trip bar 54 in a counterclockwise direction along pivot 108 from the second position (shown as position 110 in FIG. 6) to the first position (shown as position 112 in FIG. 6). When in the first position 112, trip bar 54 releases latch 150 (FIG. 9), which moves to the left in FIG. 9 and trips circuit breaker 2. When trip bar 54 is in second position 110, a bias is exerted against latch 150, and therefore, circuit breaker contacts 132, 134 may be closed.

Referring again to FIGS. 5A–5C, when handle 34 (FIG. 1) is used to reset circuit breaker 2 by moving handle 34 from the second position to the first position, a hook 114 of pivotal member 102 is engaged by handle 34 or a protrusion from handle 34 and moved in a counterclockwise direction in order to move pin 104 away from trip bar 54. Trip bar 54 returns to second position 110, allowing circuit breaker 2 to be reset. Pin 104 pushes plunger 92A back into magnet 92 where plunger 92A remains so long as no current is applied to magnet 92.

FIG. 5A and FIG. 6 disclose yet another feature of this embodiment. This feature includes an assembly to communicate to electronic trip unit 42 whether the contacts of the operating mechanism are open. Referring first to FIG. 6, when the contacts of the operating mechanism are open, a breaker cross bar 116 coupled to one or more of the contacts of operating mechanism 152 is actuated to a first position 118. When the contacts are closed, breaker cross bar 116 rotates to a second position 120 along a pivot 121. Breaker cross bar 116 provides an open/closed signal to actuator 42 representative of whether the breaker contacts are open or closed. Breaker cross bar 116 is coupled directly to the contacts in this exemplary embodiment and rotates counter-clockwise when the contacts move upward, away from the bottom contacts (e.g., contact. 134). Breaker cross bar 116 rotates clockwise when contact 132 moves downward, toward contact 134.

When in first position 118, breaker cross bar 116 exerts a force on a switch actuator 122 moving switch actuator 122 from a first position to a second position. This movement causes switch actuator 122 to rotate on pivot 124 (FIG. 5A) clockwise which provides a force against switch 126, moving switch 126 from an open position to a closed position. The position of switch 126 is sensed via circuit board 94 and provided via pins 98 to bus 72 to electronic trip unit 46 for further monitoring or processing. Alternatively, switch 126 could provide a tripped/not tripped signal to electronic trip unit 46 by coupling switch 126 to trip bar 54 with a mechanical linkage.

Also with reference to FIG. 6, an accessory retaining member 44*a* is rotatably coupled to portion 10 and spring biased in the clockwise direction. Thus, when actuator 42 is inserted into pocket 38, a protrusion 130 of actuator 42 presses resiliently against member 44*a*, rotating it counterclockwise until member 44*a* enters a notch 133 in actuator 42. A snap-tight fit results and an audible "snap" caused by member 44*a* snapping against notch 133 alerts the operator that actuator 42 is properly installed. The associated insertion of protrusion 90 into connector 70 (FIG. 4) provides further alignment and coordination for the installation of actuator 42. Thus, an accessory can be easily inserted into circuit breaker 2 and coupled thereto without the need for screws or other fasteners. A single flat tool inserted between notch 133 and member 44*a* allows removal of actuator 42.

In summary, an interlock system is disclosed which prevents closing the contacts of circuit breaker 2 when portion 10 is coupled to portion 12 (i.e., an electronic trip unit is installed) and external actuator 42 is not properly installed. Also, a single contact switch 126 coupled to 42 actuator indicates the position of the operating mechanism contacts to electronic trip unit 46. A snap-tight feature is provided by accessory retaining member 44*a* to alert the operator that actuator 42 is properly installed, the feature requiring no additional fastener, such as, a mounting screw. Furthermore, portion 12 may be removed from portion 10 without removing actuator 42 and portion 10 may still be operated via actuator 42 with an alternative system for turning actuator 42 ON and OFF.

While the embodiments illustrated in the FIGURES and described above are presently preferred, it should be understood that these embodiments are offered by way of example only. For example, various interlock mechanisms may be utilized between the actuator and the circuit breaker and/or control circuit. The invention is not limited to a particular embodiment, but extends to various modifications that nevertheless fall within the scope of the appended claims.

What is claimed is:

1. A circuit breaker, comprising:

a sensing circuit configured to generate a sense signal representative of a power signal flowing through a power circuit;

a control circuit having a frame and configured to receive the sense signal and to provide a trip signal on a first terminal;

an actuator configured to engage the control circuit frame and having a second terminal coupleable to the first terminal, the actuator configured to receive the trip signal on the second terminal;

an operating mechanism coupled to the actuator configured to open and close the power circuit in response to actuation of a lever on a trip bar, the actuator configured to actuate the lever in response to the trip signal; and an interlock mechanism coupled to at least one of the actuator and the operating mechanism, the interlock mechanism configured to actuate the lever on a trip bar when the first terminal is not coupled to the second terminal.

2. A circuit breaker having sensing means for generating a sense signal representative of a power signal flowing through a power circuit, control means for receiving the sense signal and for generating a trip signal based on the sense signal, and trip means for opening and closing the power circuit, comprising:

first means for receiving the trip signal and for tripping the trip means; and second means for determining whether the first means is coupled to the control means and for tripping the trip means when the first means is not coupled to the control means.

3. The circuit breaker of claim 2, further comprising third means for determining whether the power circuit is open and for providing an open/closed signal to the control means based on the determination.

4. The circuit breaker of claim 2, further comprising retention means for coupling the first means to the circuit breaker.

5. The circuit breaker of claim 2, wherein the first means comprises a mag-latch.

6. A method of interlocking an actuator to a circuit breaker, the circuit breaker having a sensing circuit configured to generate a sense signal representative of a power signal flowing through a power circuit, a control circuit having a frame configured to receive the sense signal and to provide a trip signal on a first terminal based on the sense signal, an actuator external to the control circuit frame having a second terminal coupleable to the first terminal, and an operating mechanism configured to open and close the power circuit, comprising:

receiving the trip signal and tripping the operating mechanism when the trip signal is received;

determining whether the first terminal is coupled to the second terminal; and tripping the operating mechanism when the first terminal is not coupled to the second terminal.

7. The method of claim 6, further comprising:

determining whether the power circuit is open; and providing an open/closed signal to the control circuit representative of whether the power circuit is open.

8. The method of claim 6, further comprising retaining the actuator to the circuit breaker cover such that an audible snap is generated.

* * * * *